US008616839B2

(12) United States Patent
Ballard, Jr. et al.

(10) Patent No.: US 8,616,839 B2
(45) Date of Patent: Dec. 31, 2013

(54) TURBINE SHELL WITH PIN SUPPORT

(75) Inventors: Henry Grady Ballard, Jr., Easley, SC (US); Fred Thomas Willett, Jr., Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/491,332

(22) Filed: Jun. 7, 2012

(65) Prior Publication Data

US 2012/0243976 A1 Sep. 27, 2012

Related U.S. Application Data

(62) Division of application No. 12/435,658, filed on May 5, 2009, now Pat. No. 8,231,338.

(51) Int. Cl.
*F01D 11/14* (2006.01)

(52) U.S. Cl.
USPC ..... 415/173.1; 415/136; 415/126; 415/137; 415/189

(58) Field of Classification Search
USPC ..... 415/136, 126, 137, 189, 173.1
See application file for complete search history.

(56) References Cited

U.S. PATENT DOCUMENTS

| | | | | |
|---|---|---|---|---|
| 2,621,018 | A * | 12/1952 | Barrett | 416/201 R |
| 3,584,967 | A | 6/1971 | Zerlauth | |
| 3,592,557 | A | 7/1971 | Haas et al. | |
| 3,628,884 | A | 12/1971 | Mierley, Sr. | |
| 3,754,833 | A | 8/1973 | Remberg | |
| 3,937,433 | A | 2/1976 | Portaleoni | |
| 4,112,582 | A | 9/1978 | Beckershoff | |
| 5,197,856 | A | 3/1993 | Koertge et al. | |
| 5,387,082 | A | 2/1995 | Matyscak | |
| 5,921,749 | A | 7/1999 | McLaurin et al. | |
| 6,244,819 | B1 | 6/2001 | Vorhees | |
| 6,457,936 | B1 | 10/2002 | Leach et al. | |
| 6,913,441 | B2 * | 7/2005 | Fadok | 415/189 |
| 7,260,892 | B2 | 8/2007 | Schilling et al. | |

OTHER PUBLICATIONS

Non-Final Office Action for co-pending U.S. Appl. No. 12/435,658, field May 5, 2009; mailed Jan. 27, 2012; 12 pages.

* cited by examiner

*Primary Examiner* — Thinh T Nguyen
(74) *Attorney, Agent, or Firm* — Cantor Colburn LLP

(57) ABSTRACT

A turbine is provided and includes a turbine shell including shrouds at multiple stages thereof, and constraining elements, disposed at least at first through fourth substantially regularly spaced perimetrical locations around the turbine shell, which are configured to concentrically constrain the shrouds of the turbine shell.

5 Claims, 7 Drawing Sheets

TURBINE SHELL WITH PIN SUPPORT

CROSS-REFERENCE TO RELATED APPLICATION

This application claims the benefit of priority of U.S. application Ser. No. 12/435,658, which was filed on May 5, 2009. The entire contents of U.S. application Ser. No. 12/435,658 are incorporated herein by reference.

BACKGROUND OF THE INVENTION

The subject matter disclosed herein relates to a turbine shell with pin support.

In gas turbines, inner turbine shells support nozzles and shrouds radially and axially with respect to a turbine rotor. The concentric support structure between the nozzles, the shrouds, and the rotor extends from the rotor bearing, to the exhaust frame, to the outer turbine shell, to the inner turbine shell and to the nozzles and the shrouds themselves. The rotor bearing is supported by the exhaust frame, which, in turn, is connected to grounded support with support legs and a gib providing engine support and stability. In addition, configurations that include a combination of inner and outer turbine shells provide additional clearance due to relative thermal response between the stator and rotor and structural isolation between the inner and the outer turbine shell.

Generally, active clearance controls are employed to radially displace inner and outer turbine shells from one another during turbine operations. This has the effect of controlling tip clearance between buckets and shrouds, which can be useful since decreasing tip clearance improves turbine performance by reducing tip leakage as long as bucket tips are prevented from contacting and thereby damaging shrouds.

Even with active clearance controls, however, in some configurations relative movement occurs between the inner and outer turbine shells due to differential thermal growth of their respective components. To reduce eccentricity caused by the relative movement, the inner turbine shell may be supported with radial pins attached to the outer turbine shell or by the use of complementary radial surfaces between the outer and inner turbine shells. In such configurations, an assembly clearance gap exists between the radial supports to prevent binding during engine operation.

In any case, when relative movement between the inner and outer turbine shells occurs, leakage paths are formed and frictional forces are generated. These frictional forces can lead to damage, such as contact surface wear on mating surfaces, which occurs during thermal expansion and contraction of either the inner or the outer turbine shell. That is, during expansion and contraction, the components experience static and dynamic frictional contact. At the same time, the friction coefficient of the components vary significantly and unpredictably. As a result, the frictional forces that impede radial displacement of the inner turbine shell relative to the outer turbine shell also vary. This variation causes the position of the inner turbine shell to shift toward and stick to the high friction locations. This friction effect combined with the assembly clearances leads to shell eccentricity that is often indeterminate within allowable clearances.

Additionally, stator tube casings are generally split at the horizontal mid-plane and incorporate a bolted flange at this horizontal joint. Thermal gradients and transient boundary conditions create an inherent out-of-roundness of the entire casing. When the inner portions are hotter than the outer portions, as is found during engine startup, such casings assume a football shape. Conversely, during engine shut down, the outer portions are warmer than the inner portions, causing the casing to assume a peanut shape. Such out-of-roundness is transmitted through the stator tube to the shrouds causing gaps between the shrouds and bucket tips, decreasing engine performance.

Shell out-of-roundness is also a problem in steam turbines. In these cases, occurrences of shell out-of-roundness may be due to a horizontal joint in the turbine shell, which acts as a heat sink and creates perimetrical variation in shell temperature. The temperature variation causes the shell to distort or ovalize. That is, the shell exhibits a greater dimension in the vertical direction than in the horizontal. The rotor, in contrast, remains circular. The ovalized shape of the shell results in increased clearances, and hence more leakage than if the stator remained circular.

BRIEF DESCRIPTION OF THE INVENTION

According to one aspect of the invention, a turbine shell is provided and includes an inner shell assembly including one of a flange and a mating surface for mating with the flange formed thereon, an outer shell assembly, which is configured to undergo radial displacement, in which the inner shell assembly is disposed, including the other one of the flange and the mating surface formed thereon, and fastening elements to couple the flange with the mating surface at flexural nodal locations of the outer shell assembly, the flexural nodal locations being identifiable in accordance with the radial displacement of the outer shell assembly, to attenuate radial displacement in the inner shell assembly.

According to yet another aspect of the invention, a turbine is provided and includes a turbine shell, having slots defined therein at least at first through fourth substantially regularly spaced perimetrical locations, a shroud ring disposed within the turbine shell and configured to radially expand or contract around a rotatable turbine bucket, and keys, formed on the shroud ring at locations corresponding to those of the slots, to mate with the slots and to axially and perimetrically position the radially expandable and contractible shroud ring within the turbine shell.

According to yet another aspect of the invention, a turbine is provided and includes a turbine shell including shrouds at multiple stages thereof, and constraining elements, disposed at least at first through fourth substantially regularly spaced perimetrical locations around the turbine shell, which are configured to concentrically constrain the shrouds of the turbine shell.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 2:
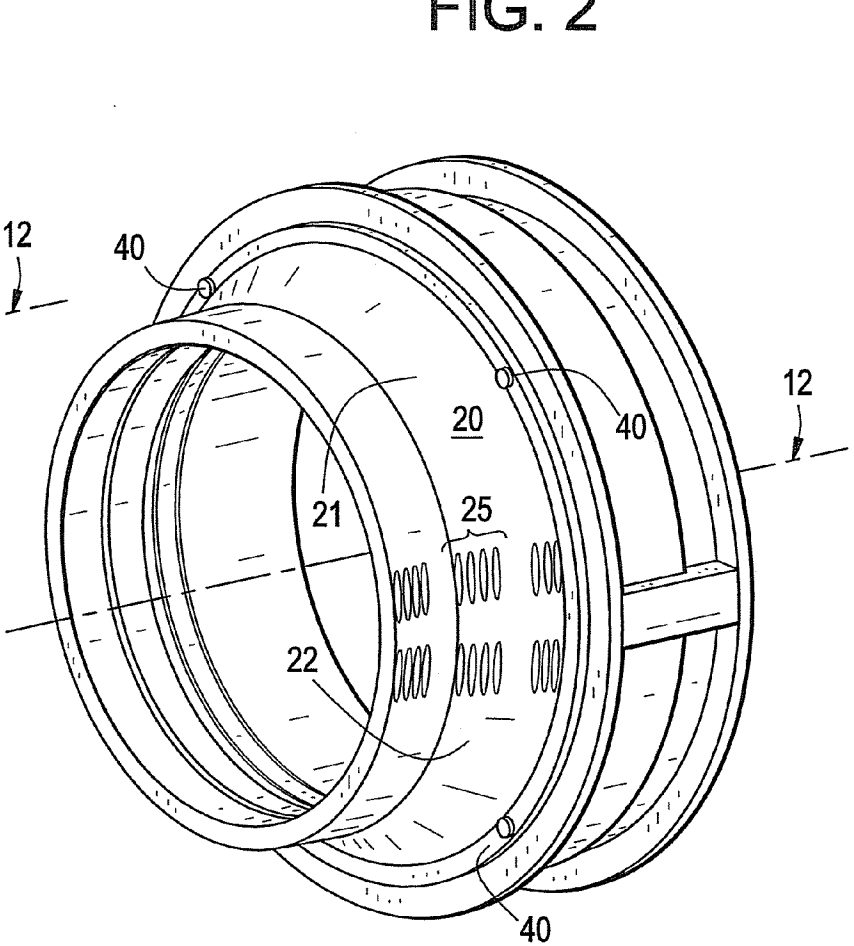
FIG. 2 is a cut-away perspective view of the turbine shell of FIG. 1.
Figure 1:
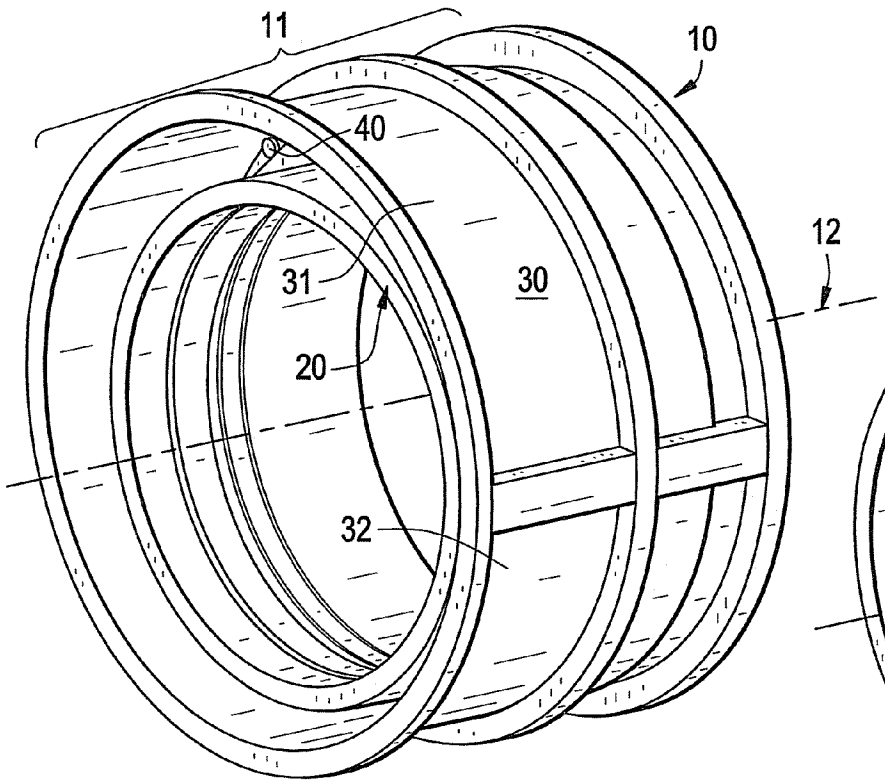
FIG. 1 is a perspective view of an embodiment of a turbine shell.
Figure 3:
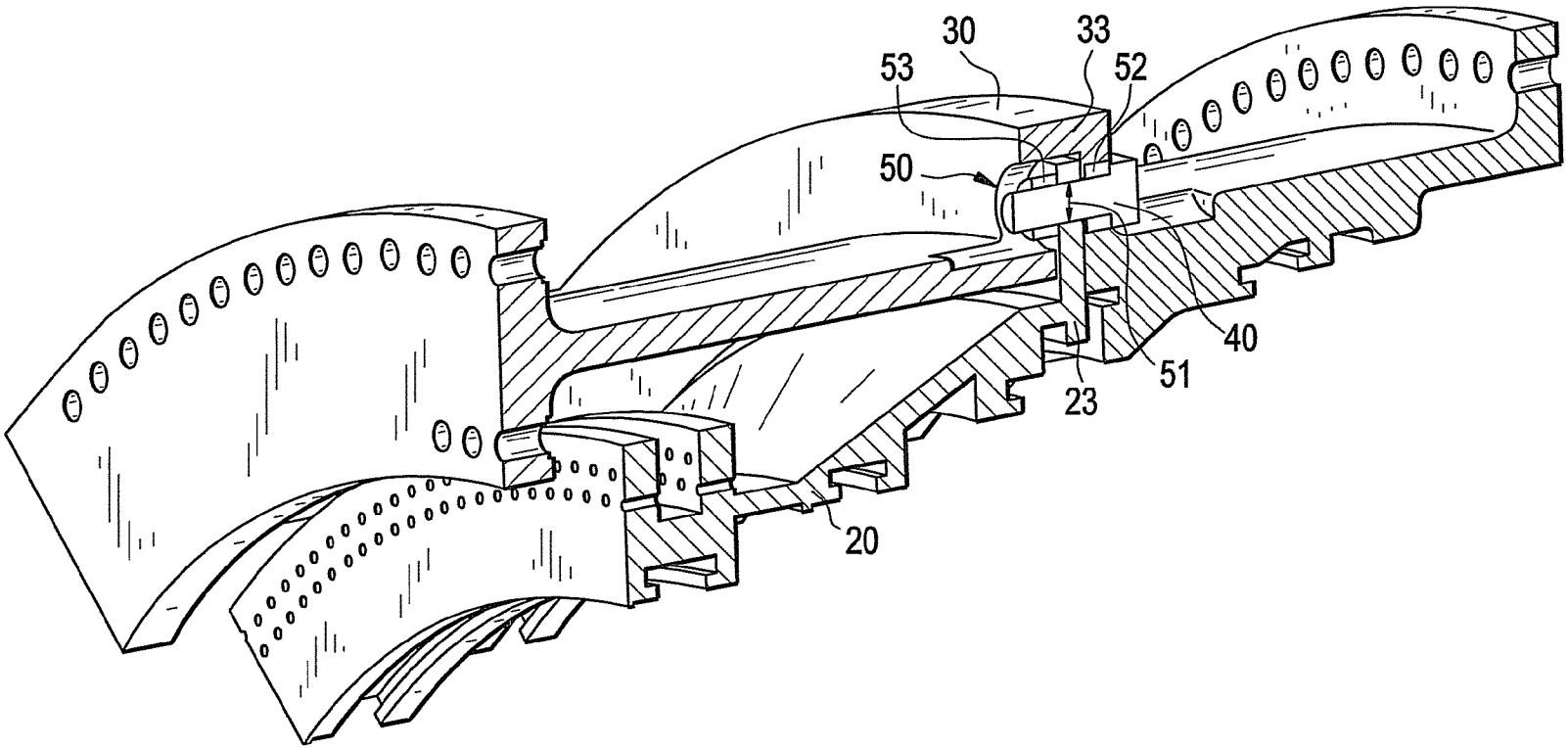
FIG. 3 is an enlarged perspective view of a portion of the turbine shell of FIG. 1.

With reference to FIGS. 1-3, a section 11 of a turbine shell 10 is provided for use in a turbine section of a gas or steam turbine. The turbine shell 10 includes an inner shell assembly 20, an outer shell assembly 30 and fastening elements 40. The inner shell assembly 20 includes a lower inner shell portion 22 and an upper inner shell portion 21, which are conjoined at mechanical joints 25, and may be disposed around a centerline 12 of the turbine 10. The inner shell assembly 20 further includes a flange 23. The outer shell assembly 30 includes a lower outer shell portion 32 and an upper outer shell portion 31 and defines a space in its interior in which the inner shell assembly 20 is disposed. A mating surface 33, such as a portion of the outer shell assembly 30 formed into a pocket into which the flange 23 is receivable, is formed at or in a portion of the outer shell assembly 30. The mating surface 33 has a size and shape that complements the flange 23 such that the flange 23 can be mated to the mating surface 33 when the inner shell assembly 20 is installed within the outer shell assembly 30.

As shown, the flange 23 and the mating surface 33 may be incorporated into relatively continuous respective features or may be provided as multiple features. Where they are provided as relatively continuous respective features, the flange 23 may be incorporated into a relatively continuous perimetrical flange extending around the inner shell assembly 20. Similarly, the mating surface 33 may be incorporated into a relatively continuous perimetrical surface extending around the outer shell assembly 30. In addition, the flange 23 and the mating surface 33 may extend in radial directions beyond a periphery of the outer shell assembly 30.

Although the flange 23 and the mating surface 33 are described above and shown in FIGS. 1-3 as being disposed on the inner shell assembly 20 and the outer shell assembly 30, respectively, this arrangement is merely exemplary and it is to be understood that the inner shell assembly 20 could include a portion onto which the mating surface 33 is formed and that the outer shell assembly 30 could likewise include the flange 23.

As shown in FIG. 3, the fastening elements 40 cooperate with mating surface through-holes 50 and flange through-holes 51 to couple the flange 23 with the mating surface 33 at least at substantially regularly spaced perimetrical locations. The fastening elements 40 may be axially located downstream of the first stage shrouds, which, in this case, includes the inner and outer shell assemblies 20 and 30. The fastening elements 40 may include pins or, more specifically, pre-tensioned bolts having centerlines that are each parallel with longitudinal axes of the inner and outer shell assemblies 20 and 30. Alignment of the fastening elements 40 can be at least partly achieved by way of alignment bushings 52 through which the fastening elements 40 are extendable and threaded nuts 53 into which the fastening elements 40 may be fixedly inserted.

Figure 4:
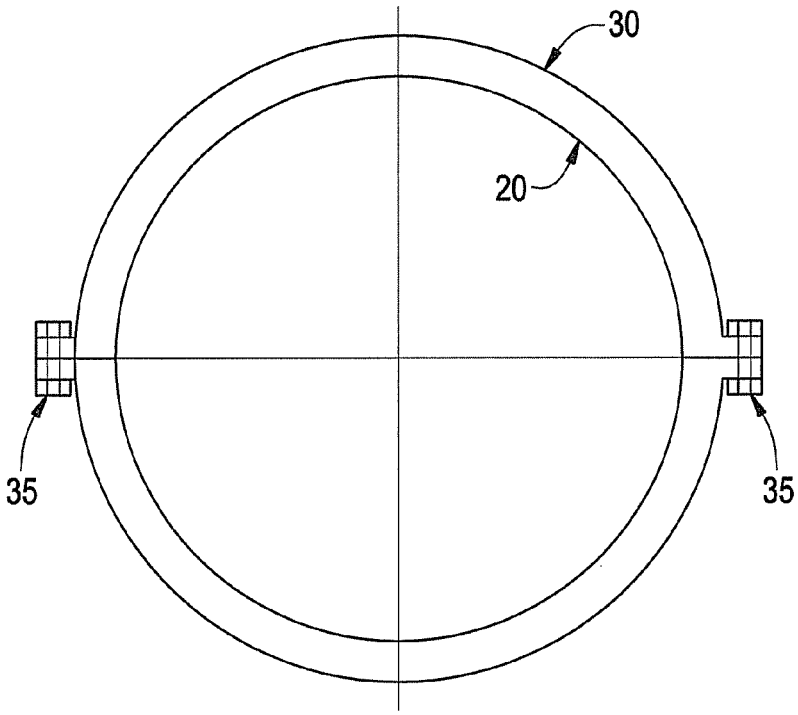
FIG. 4 is a schematic axial view of a turbine shell.

With reference to FIG. 4, it is noted that several loads are generally applied to the outer shell assembly 30 and include, but are not limited to, the load applied by the mechanical connection 35, which could be provided on both sides of the outer shell assembly 30 and which conjoins the lower outer shell portion 32 and the upper outer shell portion 31 at a horizontal joint. The combined loads tend to cause the outer shell assembly 30 to experience radial displacement due to thermal contraction and expansion during normal operations. The fastening elements 40 attenuate radial displacement of the inner shell assembly 20 that would otherwise be caused by the radial displacement of the outer shell assembly 30.

Figure 5:
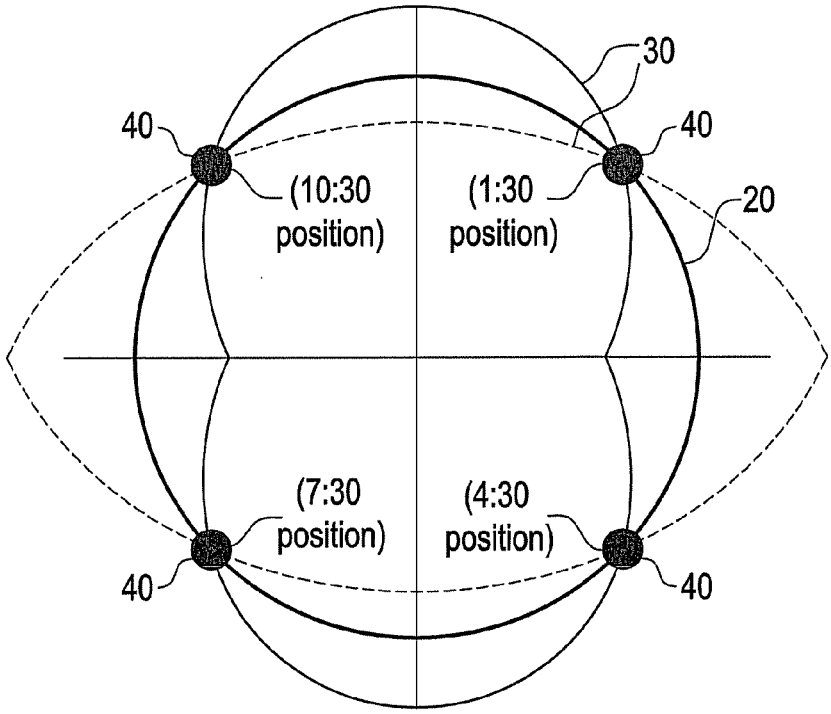
FIG. 5 is a schematic axial view of the turbine shell of FIG. 4 undergoing thermal expansion and contraction.
Figure 6:
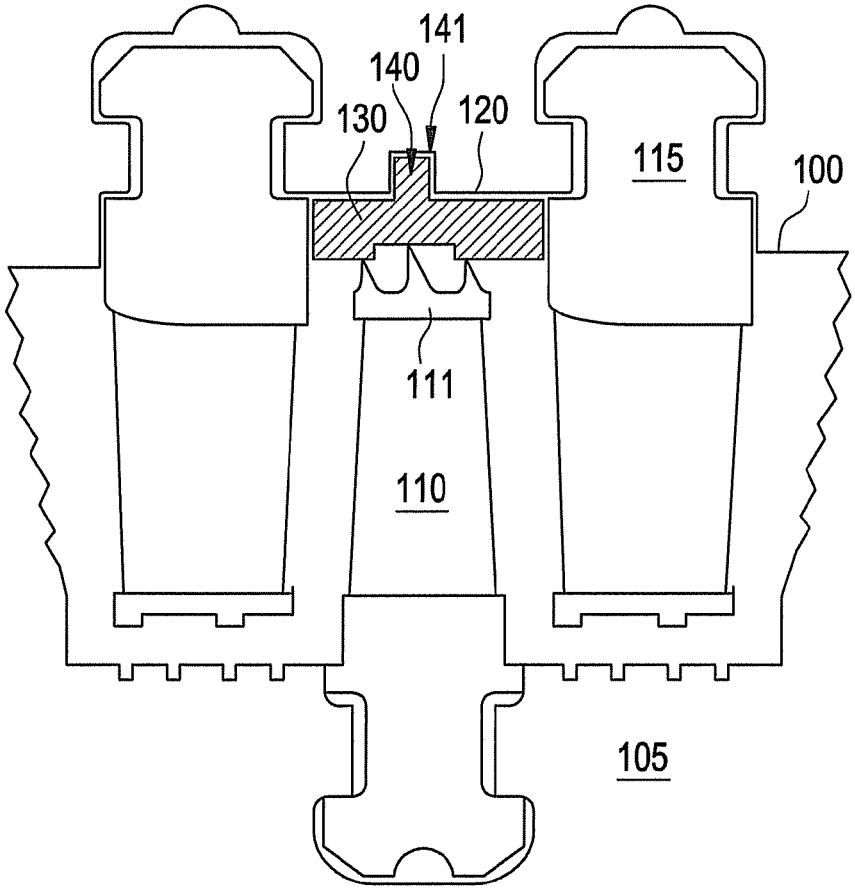
FIG. 6 is a sectional view of a shroud ring surrounding bucket tips of a turbine.
Figure 7:
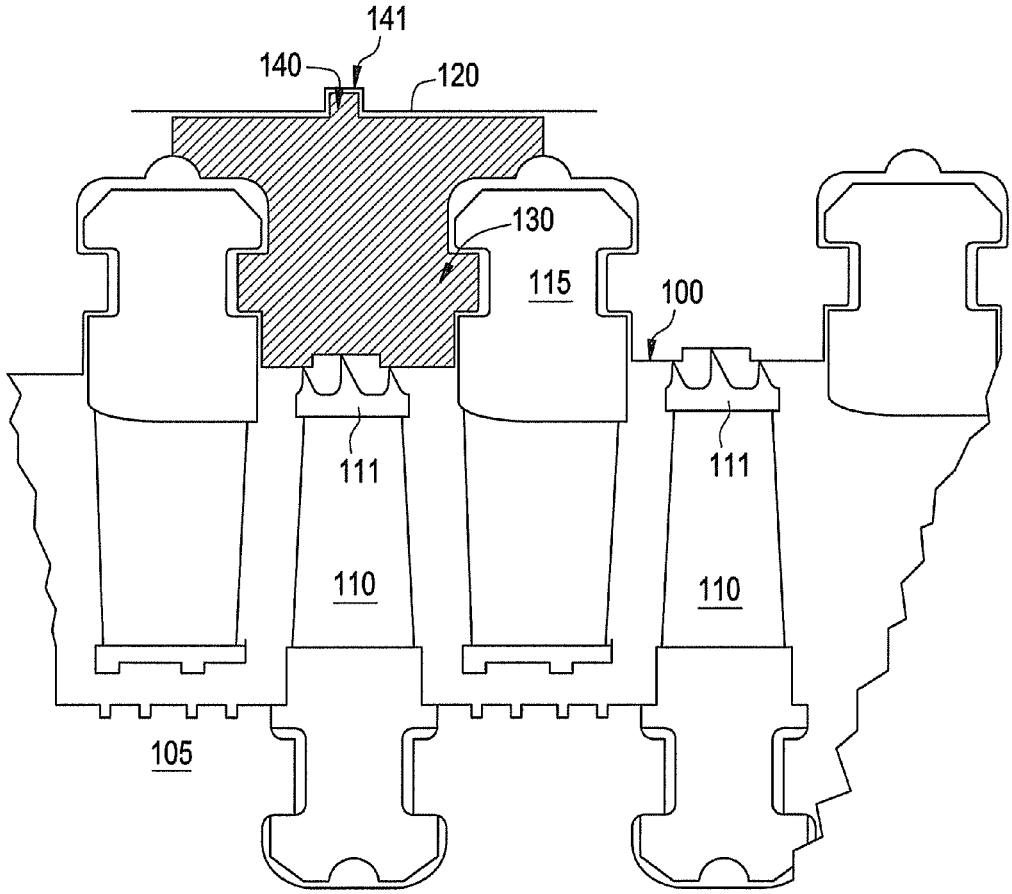
FIG. 7 is a sectional view of a shroud ring surrounding bucket tips of a turbine.
Figure 8:
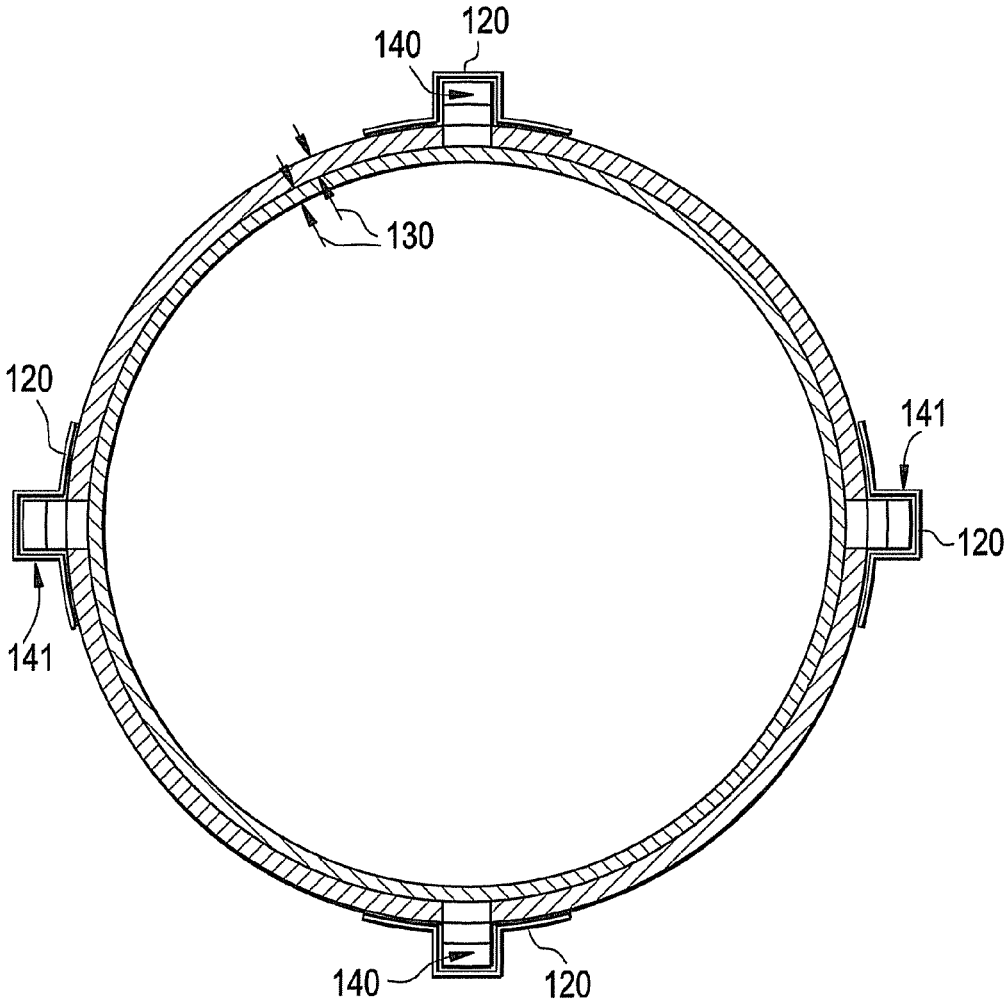
FIG. 8 is a longitudinal view of the shroud ring of FIG. 6.
Figure 9A:
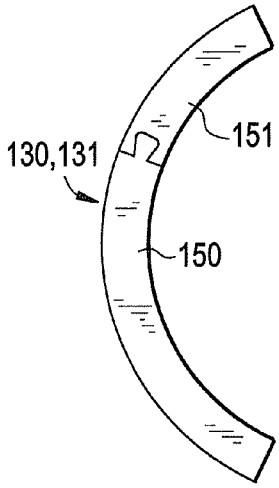
FIGS. 9A-E are schematic views of connections between first and second parts of the shroud ring of FIG. 6.
Figure 9B:
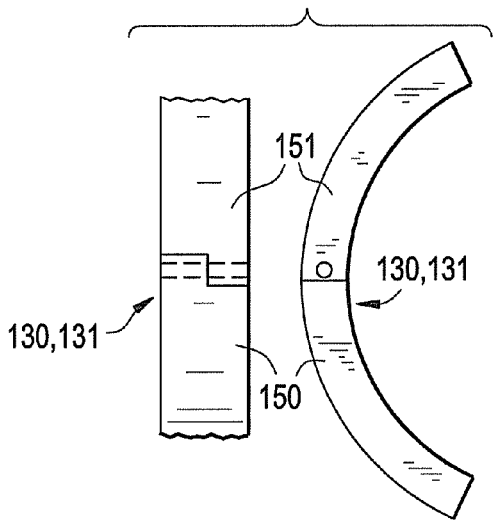
Figure 9C:
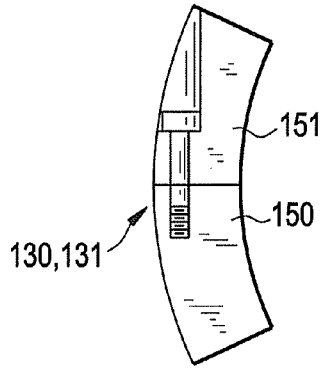
Figure 9D:
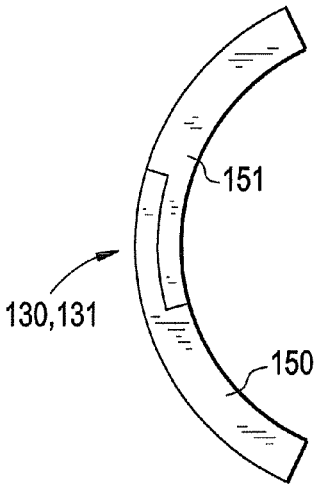
Figure 9E:
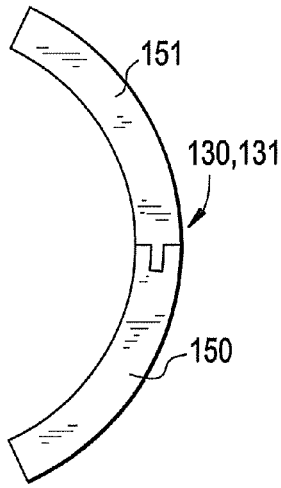

The outer shell assembly 30, being loaded as described above, tends to experience radial displacement in the form of a Fourier N=2 shape. That is, during start-up operations, the interior of the outer shell assembly 30 will be hotter than its exterior and the outer shell assembly 30 will, therefore, tend to assume a shape of a football. Conversely, during shut-down operations, the interior will be colder than the exterior and the outer shell assembly 30 will, therefore, tend to assume a shape of a peanut. Thus, flexural nodal locations of the outer shell assembly 30 are established at those portions of the outer shell assembly 30 that remain substantially radially fixed. As shown in FIG. 5, these flexural nodal locations are proximate to the 1:30, 4:30, 7:30 and 10:30 perimetric locations of the outer shell assembly.

The fastening elements 40 may be disposed at the flexural nodal locations of the outer shell assembly 30 to have a Fourier N=4 shape. With such an arrangement, radial displacement of the outer shell assembly 30 can be attenuated in the inner shell assembly 20 along the centerline 12. Thus, shrouds at multiple stages of the inner shell assembly 20 may be isolated from out-of-roundness characteristics of the outer shell assembly 30 with eccentricities and out-of-roundness characteristics of the outer shell assembly 30 not being transmitted to the inner shell assembly 20.

Performance of the turbine 10 is, therefore, improved, as gaps between turbine bucket tips and their complementary shrouds can be maintained increasingly uniformly both with and without active clearance controls. As such, a need for relatively complex hardware and control algorithms for maintaining active clearance controls can be reduced and/or substantially eliminated.

In addition, when the fastening elements 40 are employed, as described above, at the flexural nodal locations, eccentricities caused by frictional variation in components of the inner shell assembly 20 and the outer shell assembly 30 may also be mitigated. That is, with the fastening elements 40 positioned at the flexural nodal locations, there is a substantial reduction in relative radial displacement between the inner shell assembly 20 and the outer shell assembly 30 at each of those flexural nodal locations. Thus, concentricity is substantially deterministically maintained.

With reference to FIGS. 6-9A-E and in accordance with another aspect, a turbine 100 is provided and includes a turbine shell 120, a shroud ring 130 and keys 140. The turbine shell 120 has slots 141 defined therein at least at first through fourth substantially regularly spaced perimetrical locations. The shroud ring 130 is disposed within the turbine shell 120 and is formed of materials which have a thermal mass that is relatively small in comparison with those of components of the turbine shell 120 and a rotatable turbine bucket 110. Thus, the shroud ring 130 is configured to radially expand or contract around the rotatable turbine bucket 110 in response to operating conditions of the turbine 100.

The keys 140 are formed on an outer perimeter of the shroud ring 130 at locations corresponding to those of the slots 141. In this way, the keys 140 mate with the slots 141 and axially and perimetrically position the shroud ring 130 within the turbine shell 120.

The shroud ring 130 may include first and second 180° parts 150 and 151. As shown in FIGS. 9A-E, these parts 150 and 151 may be fastened together at a dovetail joint, they may be coupled to one another by a joint or a bolt or they may be overlapped or slotted with one another. Of course, it is to be understood that the configurations of FIGS. 9A-E are merely exemplary and that other structures and configurations are possible. In any case, with the shroud ring 130 formed of first and second parts 150 and 151, the shroud ring 130 may be assembled within the turbine shell 120 with relatively low associated costs and in relatively short time.

The turbine bucket 110 may be joined to a rotor 105 about which the turbine bucket 110 is rotatable. In this case, the turbine shell 130 may be formed to be generally coaxial with the rotor 105.

With the shroud ring 130 disposed within the turbine shell 120, as described above, the shroud ring 130 and the flow path associated with a distal end or tip 111 of the turbine bucket 110 is thermally isolated from the turbine shell 120. As a result, the flow path is substantially decoupled from thermally induced expansion or contraction of the turbine shell 120.

The shroud ring 130 may be disposed at a single nozzle stage or at multiple nozzle stages. In either case, the shroud ring 130 may be further disposed between the turbine shell 120 and the turbine bucket 110 as well as between the turbine shell 120 and nozzles 115 positioned fore and aft of the turbine bucket 110. Here, the shroud ring 130 and the flow path associated with a distal end or tip 111 of the turbine bucket 110 are thermally isolated from the turbine shell 120 and, in addition, the nozzles 115 are thermally isolated from the turbine shell 120.

In accordance with yet another aspect, a turbine, such as turbine 100, is provided and includes a turbine shell 10, 120 and constraining elements 40, 140. The constraining elements 40, 140 are disposed at least at first through fourth substantially regularly spaced perimetrical locations around the turbine shell 10, 120 and are configured to constrain an eccentricity of the turbine shell 10, 120. The turbine shell 10 may include an inner shell 20 and an outer shell 30. Here, the constraining elements include the fastening elements 40 described above. Alternatively, the turbine shell 120 may have slots 141 defined therein at least at first through fourth substantially regularly spaced perimetrical locations. In this case, the constraining elements include the aforementioned keys 140 that are formed on the shroud ring 130 described above. The keys 140 mate with the slots 141 axially and perimetrically position the shroud ring 130 within the turbine shell 120.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine, comprising:

a turbine shell, having slots defined therein at least at first through fourth substantially regularly spaced perimetrical locations;

a shroud ring disposed within the turbine shell and configured to radially expand or contract around a rotatable turbine bucket; and keys, formed on the shroud ring at locations corresponding to those of the slots, to mate with the slots and to axially and perimetrically position the radially expandable and contractible shroud ring within the turbine shell.

2. The turbine according to claim 1, wherein the shroud ring thermally isolates the turbine shell from a flow path associated with the turbine bucket.

3. The turbine according to claim 1, further comprising nozzles disposed axially fore and aft of the turbine bucket.

4. The turbine according to claim 3, wherein the shroud ring thermally isolates the turbine shell from the nozzles.

5. The turbine according to claim 1, wherein the shroud ring has a relatively small thermal mass as compared to that of the turbine shell and the turbine bucket.

* * * * *